US007351309B2

(12) United States Patent
Kurki et al.

(10) Patent No.: US 7,351,309 B2
(45) Date of Patent: Apr. 1, 2008

(54) ROLL IN A PAPER OR BOARD MACHINE AND A DRYER GROUP IN A PAPER OR BOARD MACHINE

(75) Inventors: Matti Kurki, Jyväskylä (FI); Pekka Martikainen, Vaajakoski (FI)

(73) Assignee: Metso Paper, Inc., Helsinki (FI)

( * ) Notice: Subject to any disclaimer, the term of this patent is extended or adjusted under 35 U.S.C. 154(b) by 534 days.

(21) Appl. No.: 10/959,456

(22) Filed: Oct. 6, 2004

(65) Prior Publication Data

US 2005/0075229 A1 Apr. 7, 2005

(30) Foreign Application Priority Data

Oct. 7, 2003 (FI) ..... 20031461

(51) Int. Cl.
*D21F 5/04* (2006.01)

(52) U.S. Cl. ..... 162/207; 162/363; 162/367; 162/368; 162/372; 34/116; 492/20; 492/30

(58) Field of Classification Search ..... 162/363, 162/364, 367, 370, 371, 374, 206, 207; 34/109, 34/111, 116, 117, 120; 492/20, 30, 38
See application file for complete search history.

(56) References Cited

U.S. PATENT DOCUMENTS 3,259,961 A 7/1966 Bryand
3,283,415 A 11/1966 Schnyder
3,550,286 A 12/1970 Konttinen
3,773,613 A 11/1973 Lee et al.
4,202,113 A * 5/1980 Kankaanpaa ..... 34/456
4,359,828 A * 11/1982 Thomas ..... 34/114
4,441,263 A 4/1984 Vedenpää
4,516,330 A 5/1985 Eskelinen et al.
4,677,762 A * 7/1987 Futcher ..... 34/114
4,882,854 A * 11/1989 Wedel et al. ..... 34/115
4,888,883 A * 12/1989 Kerttula ..... 34/116
4,905,380 A 3/1990 Eskelinen et al.
5,022,163 A 6/1991 Ilvespää et al.
5,172,491 A 12/1992 Ilvespää et al.
5,241,760 A * 9/1993 Wedel ..... 34/115
5,347,728 A 9/1994 Pinter et al.
5,495,679 A 3/1996 Deshpande et al.
5,522,151 A * 6/1996 Deshpande et al. ..... 34/114
5,542,192 A 8/1996 Deshpande et al.
5,996,244 A 12/1999 Saarikivi et al.

* cited by examiner

*Primary Examiner*—Eric Hug
(74) *Attorney, Agent, or Firm*—Stiennon & Stiennon

(57) ABSTRACT

A roll in a paper or board machine has a roll frame or center shaft (15) with bearings mounted at its ends and a groove-like surface structure (10). There is a contact between the surface structure and the center shaft so that an essentially closed structure is formed. The roll produces a vacuum that keeps the web attached to the outer surface of a fabric in the fabric wrap area of the roll circle by utilizing the boundary layer airflows of the surface structure flow and/or of the web. A dryer group has at least one contact dryer cylinder and at least one turning roll with a single fabric run arrangement.

12 Claims, 8 Drawing Sheets

ROLL IN A PAPER OR BOARD MACHINE AND A DRYER GROUP IN A PAPER OR BOARD MACHINE

CROSS REFERENCES TO RELATED APPLICATIONS

This application claims priority on Finnish Application No. 20031461, Filed Oct. 7, 2003, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to rolls and dryer groups in a paper or board machine.

The use of double fabric run and/or single fabric run arrangements in the dryer groups of multi-cylinder dryer sections of paper or board machines is previously known. In the double fabric run arrangement the dryer cylinder groups have two fabrics pressing the web one from above and the other from below against heated cylinder surfaces. Between the dryer cylinder rows, generally horizontal rows, the web has, in the double fabric run arrangement, free and unsupported draws, which are liable to fluttering, which may cause web breaks, particularly at such drying stages, in which the web is still relatively moist and therefore weak for its strength. Due to this, during several past years there has been increasing use of the said single fabric run arrangement, in which each dryer cylinder group has only one dryer fabric, supported by which the web travels through the entire group, the dryer fabric pressing the web against the cylinder surfaces heated by the dryer cylinders and the web remaining outside the outer curve at the turning cylinders or turning rolls located between the dryer cylinders. Thus, in the single fabric run arrangement, the dryer cylinders are positioned outside the fabric loop and the turning cylinders or turning rolls are located inside the loop. In so called normal single fabric run groups the dryer cylinders are in the top row and the turning cylinders or turning rolls are in the bottom row, and correspondingly, in so called turned single fabric run groups, the dryer cylinders are in the bottom row and the turning cylinders or turning rolls are in the top row.

In known dryer groups adapting the single fabric run arrangement the dryer fabric and the paper web are transferred from the previous drying element, such as a contact dryer cylinder, to a turning or suction cylinder or similar in a common straight run, whereby a closing wedge space, also referred to below as closing nip, is formed between the dryer fabric and the last-mentioned turning cylinder or suction cylinder surface. The dryer fabric and the cylinder surfaces moving towards this nip tend to generate positive pressure in the said wedge space by means of the boundary layer flows conveyed by them. This again produces a pressure difference over the paper web supported by the dryer fabric, the pressure difference having a tendency to detach the paper web from the dryer fabric causing runnability problems, wrinkles, and even web breaks. On the other hand, for improving the efficiency of dryer sections, the need arises for using dryer sections with a more compact construction than heretofore, in which the contact dryer cylinders and the mentioned suction cylinders are as close as possible to each other. All these aspects together with rising web speeds increase the overpressure problems of the said closing nip. It is previously known that the transfer of the paper web in the single fabric run arrangement on the contrary from the turning suction cylinder to the contact dryer cylinder takes place after a so called opening nip, supported by the dryer fabric. In dryer sections suitable for the single fabric run arrangement, the term pocket space is used to refer to the pocket-like space, which is limited by two parallel dryer cylinders and the turning cylinder and dryer fabric between them.

In the solutions known in the prior art technique, attempts have also been made to remove the problems occurring in the area of the closing nip by means of roll suction, roll sector suctions and various types of vacuum-generating boxes as well as by using combinations of rolls and suction boxes, which, however, have not necessarily been able to completely eliminate the problems in this area in an energy-efficient manner. At high machine speeds the requirement of energy used for web stabilization also strongly increases. Typically the power requirement increases to the power of three in relation to the web speed.

A solution for removing the problems in this area is set forth in the FI patent No. 105573 (corresponding U.S. Pat. No. 5,996,244), which discloses a roll in a paper machine, particularly in a paper drying device, and a dryer group in a paper machine, in which the roll in the paper drying device comprises a shaft, supported by which the roll is adapted to rotate, and a surface structure, connected to the shaft with support pieces or similar, in which the openness of the surface structure of the roll is more than 10% and the surface structure of the roll is open in a slot-like manner so that during the roll rotation an effect is produced that aspirates air to inside the roll, whereby an air flow-through is created through the roll. In a dryer group of a paper machine, in which dryer group the single fabric run arrangement is adapted, at least one of the turning rolls of the dryer group is an open roll of the type described above.

SUMMARY OF THE INVENTION

The object of the present invention is to develop further the above-described corresponding technique in order to principally solve the problems related to the web transfer in the mentioned closing nip area as well as in the turning roll area covered by the web.

Particularly at high speeds, e.g. exceeding 1,400 m/min, an extremely critical area for runnability at the beginning of a dryer section equipped with a single fabric run arrangement is the above-described closing nip area of the turning cylinder, and the object of the invention is therefore to set forth more efficient and more energy-saving new constructions for removing the drawbacks in this area prone to runnability problems.

The object of the invention is to set forth a roll during the use of which runnability problems in the closing nip area of the turning roll are eliminated or at least minimized.

Another object of the invention is to set forth a dryer group of a paper machine that is better for runnability than the known solutions.

The invention is based on a roll having a large open surface area, with its key characteristic being the capability to create a vacuum in the fabric wrap area together with the dryer fabric or the dryer fabric and paper. The generation of vacuum is based on a) a change in the angular momentum of the in-going gas flow, such as airflow, taking place in the closing nip, which intensifies the inflow, b) flow adjustment and pumping in the roll grooves and channels, which flows are influenced by the centrifugal forces created by the roll rotation, and c) the vacuum effect of the opening nip, which aspirates gas, e.g. air, creating a vacuum, whose effect extends to the entire fabric wrap area.

Although the following description discusses airflows, air space, etc., this is not, however, intended to restrict the invention to such situations only, in which the flow is air. The flow can also be another gas (fluid).

The design of the roll according to the invention also allows increasing the vacuum-producing capacity of the roll along with a rising running speed, since the vacuum of the roll wrap area develops according to the formula $$p=\zeta_f v^b [b=1.3\text{-}2],$$

where p=vacuum change, $\zeta_f$=fluid density, and v=running speed.

According to the invention the roll comprises a surface structure having a large, most preferably groove-like open surface area, such as plate disks, and a center shaft and/or alternatively roll frame with grooves machined in it. According to the invention, both the vacuum produced by the roll and its profile on the roll surface are optimized to the maximum so that a contact exists, if required, between the surface structure, such as the plates, and the center shaft, i.e. there is no free air space between the roll frame and the grooves. According to the invention, a roll construction preferable for efficiency is provided for example by attaching plates with different diameters to a solid frame roll/shaft, the plates forming the grooving when placed at suitable intervals.

In the roll according to the invention the surface structure is so formed that most preferably a grooving is formed, in which the depth of each groove is approximately 10-155 mm, most appropriately 18-85, and the groove width is 1-50 mm, most appropriately 6-10 mm. The proportion of the groove width to the land width is most appropriately 0.6-2.0.

The most common form for the roll surface grooving is the U shape or one very much similar to it. The grooving can be straight or spiral. The grooving can be made by disk cutting and/or turning the frame roll surface. It can also be produced by welding, gluing or mechanically locking separate plate disks, made of metal, polymer or combinations of several materials, to the frame roll surface, in which case the part in contact with the fabric or otherwise the most external part is highly wear-resistant. The grooving can also be produced using a so-called G strip technique, in which the strip is applied directly on top of the smooth frame roll or in special mounting grooves in the frame roll surface. As a special application, the G strip is applied to an old or new frame roll by means of a support strip.

When the roll functions in the application placed against the fabric, the edges in the land supporting the fabric can be rounded, e.g. with a rounding radius of R=1-3 mm, or the whole land can be made to a slight circular arch, say with a radius of curvature of R'=100-500 mm, or the form can be selected in some other way so that the surface pressure between the fabric and the roll is optimal and the fabric wear is reduced.

The roll according to the invention can have a perforation at the bottom of the grooves, or the frame roll can have a perforation independent of the grooving geometry. In addition, according to a special aspect of the invention, the perforation can also appear at the groove peak/land so that the perforation opens to the contact surface of the fabric. This construction is particularly useful in a tail threading situation, since the tail can be stabilized to the fabric surface more efficiently with a higher vacuum.

When using a roll according to the invention, a dryer fabric that is normal for permeability is intended, such as a dryer fabric, whose permeability is 500 $m^3/(m^2h)$, preferably 1,000-35,000 $m^3/(m^2h)$, most appropriately 1,000-5,000 $m^3/(m^2h)$.

The advantages of the invention are its efficiency and simplicity. According to a preferable embodiment of the invention, the roll diameter is for example 1,500 mm. Separate plate disks have been attached for example by welding to a frame construction with a diameter of 1,300 mm, which does not need to be an actual frame roll, but a support construction similar to it. The height of the plate disks is 100 mm and their width is 6 mm. A 7-mm wide open groove remains between the plate disks. The peak of the plate disk is rounded with the radius of curvature R'=150 mm. A simulation model has provided results according to which the roll generates a good vacuum on its surface both in the closing and in the opening nip as well as a vacuum of almost the same level −500 to −900 Pa in the rest of the fabric-covered area on the roll surface. With the plate arrangement/grooving according to this preferable embodiment of the invention, the vacuum of the roll surface can be brought to a level of −500 to −900 Pa, based on the results achieved from the simulation, depending on the position of the wrap area. These pressure levels are for example of the same class as with the suction roll marketed with the trademark VacRoll™ of Metso Paper, Inc., in which the suction air volume is 400 $m^3/(hm)$ (2000 m/min). This vacuum in the fabric wrap area is achieved with the indicated power entirely without external aspiration or without runnability components in the pocket space.

The roll according to the invention, having a groove structure, such as lands of plate, preferably adapted around a solid center shaft or a frame roll, provides an inwardly air pumping phenomenon in the groove construction, which is generated when the air conveyed with the fabric hits against the roll surface and the groove walls, such as the plates. The airflow accelerates in the grooves and then exits from the opening nip. The inwardly pumping phenomenon in the roll according to the invention, providing a vacuum without special roll-external vacuum-providing equipment, is intensified with an increasing rotating speed. Thus, it automatically produces its own vacuum utilizing external boundary layer flows and/or blasting flows starting from the closing nip of the turning cylinder and continuing until to the opening nip, and this enables providing a preferable and efficient paper machine roll, which is particularly useful as a turning roll/cylinder of the dryer groups of a paper machine dryer section.

The roll creates the vacuum effect due to the fact that in the closing nip there occurs a change of angular momentum of the gas (fluid) flowing to the grooves. The gas flow directed to the roll grooves proceeds in the roll grooves to the area of the opening roll nip, whereby a vacuum effect is created, which extends over the entire fabric wrap area.

The roll surface structure is formed in such a manner that the vacuum effect and gas pumping are created by the friction between the structure and the fluid, the boundary layer, and accelerating movement of gas.

In the roll according to the invention, air hits against the surfaces of the groove walls, such as plates, placed around the center shaft, whereby the groove walls tend to pump the air forwardly and particularly in a closing nip, also inwardly towards the shaft. Air circulates around the roll frame until to the opening nip. In this way the vacuum effect is created by a combined effect of three factors, i.e. the impact, flow and opening nip.

In connection with the invention it is possible to use a blow box according to a preferable embodiment of the invention described below in more detail, which is used to intensify the effect of the opening nip for example with trailing side aspiration, or on the other hand, a blow directed to a closing nip is used to intensify the impact and flow effect on the side of the closing nip. In addition, it is preferable to separate these areas of influence of the opening and closing nip from one other with a sealing in the roll axial direction/a blow box wall construction.

According to a preferable further characteristic of the invention, in a drying geometry based on the single fabric run design, besides the roll according to the invention, a box constructed on the leading side is used, built up of a separate blow box including a flexible nozzle solution and a passive box space attached below it, which has aspiration/an ejection blow, if required, and is open at the bottom part.

In this embodiment of the invention, aspiration is directed to the suction zone of the blow box using the passive box section. When this box is realized according to the blow nozzle/flow divider principle, it is possible to achieve a vacuum of approximately −1000 Pa in the high-vacuum zone (2.2 mm nozzle, blow air volume 900 $m^3$/(hm)).

This embodiment of the invention preferably also includes two flow divider/sealing elements in the box on the leading side, and by adjusting their distance to the fabric it is easy to adjust the vacuum of both the high-vacuum zone and the vacuum influencing in the open gap area, which keeps the web on the fabric surface before it comes to the influence area of the roll according to the invention. This allows efficiently preventing excessive bending of the fabric.

The total air volume requirement in the above-described system is 900 $m^3$/hm per blow box, which is 50% of the present blow box/VacRoll™ total air volume. Consequently, the blower power requirement also decreases by 50%, which in practice can mean a decrease of approximately 1 MW in the power consumption in the dryer section of a large modern paper machine. It is remarkable that the roll according to the invention preferably replaces this underpressurized turning roll, in which case runnability components (e.g. blow boxes) that are almost like the present ones are used in the pocket space, designed to improve/intensify the performance of the proposed roll.

The roll according to the invention is also easy to keep clean, because the airflows automatically created by it simultaneously prevent dirtying of the roll surface structure and grooving. Therefore, an advantage of the roll according to the invention is also in its operating principle, the flow direction changes during the rotation cycle whereby each point in the roll grooves is subjected to inflow and outflow, and the roll is then kept clean for a longer time.

According to a preferable further aspect of the invention, it is possible, if required, to arrange, in connection with the roll according to the invention, an adjustment/suction possibility through a connection placed on the roll hub for adjusting the vacuum effect as desired. This kind of connection can also be used in a situation in which at least one part in the roll axial direction is realized according to the known technique. The area of the tail or both edges, for example, could be constructed for this kind of adjustment, because the intensification of the vacuum effect by dividing the blow box in the cross-machine direction is not necessarily as efficient or easy to implement.

According to a preferable further characteristic of the invention, in the roll axial direction there is at least one part in which the air is adapted flowing through the openings in the roll shell to the roll interior.

The invention is described below in more detail by making reference to the figures in the enclosed drawing, to the details of which the invention is not intended to be strictly limited in any way.

BRIEF DESCRIPTION OF THE DRAWINGS

FIG. 1B.1 is an alternative partial enlargement A' of the region A in FIG. 1B, showing the radius of curvature at the corners of a land.

FIG. 1B.2 is another alternative partial enlargement A" of the region A in FIG. 1B, showing the radius of curvature formed large at a land.

DESCRIPTION OF THE PREFERRED EMBODIMENTS

Figures 1A, 1B, 1C, 1D, 1E, 1F, 1G:
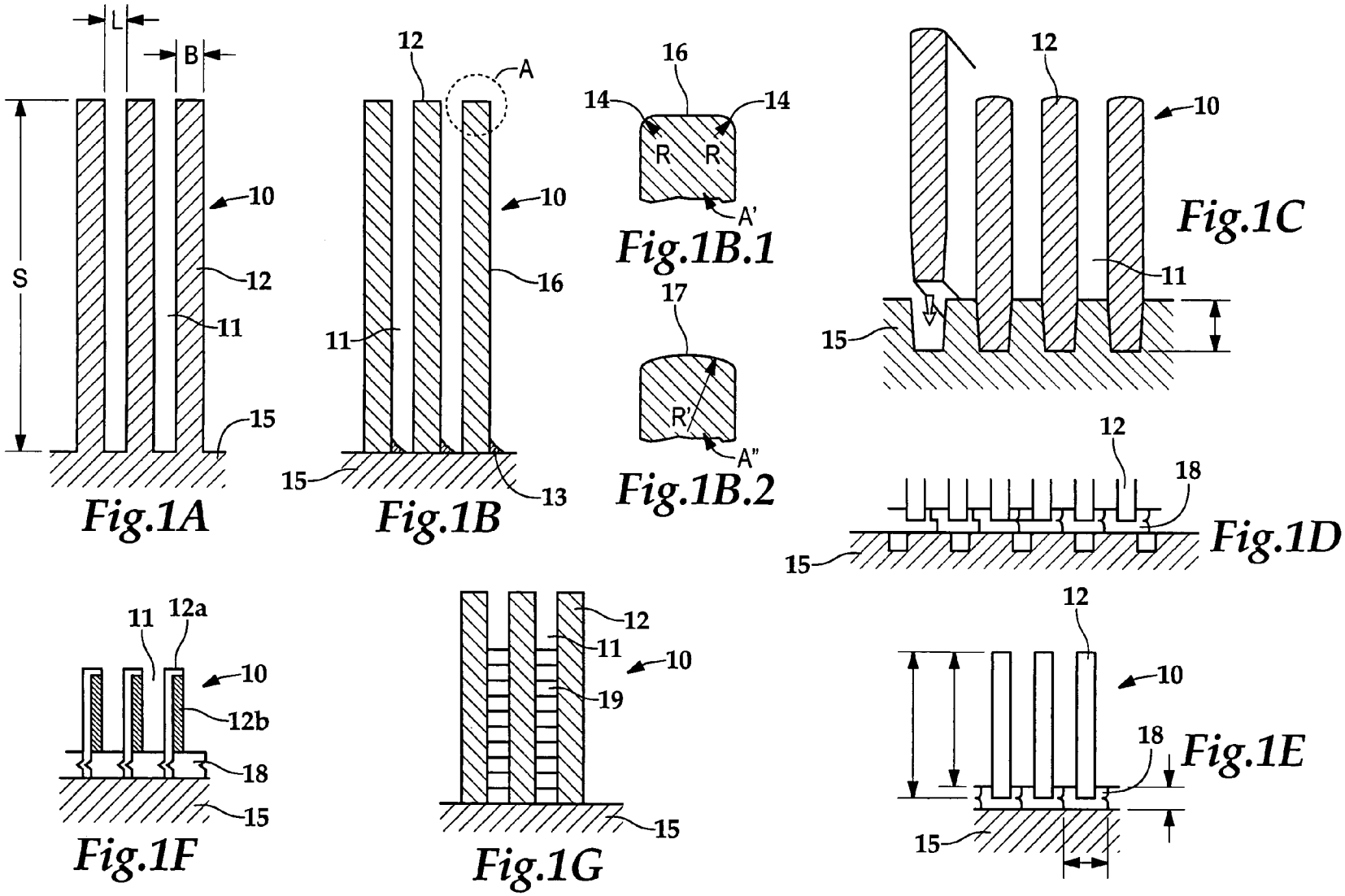
FIG. 1A is a schematic view of the surface structure of an embodiment of the roll of this invention.
FIG. 1B is a schematic view of the surface structure of an embodiment of the roll of this invention.
FIG. 1C is a schematic view of the surface structure of an embodiment of the roll of this invention.
FIG. 1D is a schematic view of the surface structure of an embodiment of the roll of this invention.
FIG. 1E is a schematic view of the surface structure of an embodiment of the roll of this invention.
FIG. 1F is a schematic view of the surface structure of an embodiment of the roll of this invention.
FIG. 1G is a schematic view of the surface structure of an embodiment of the roll of this invention.

FIG. 1A shows a surface structure 10 realized according to an embodiment of the roll according to the invention, in which the surface structure 10 is formed of turned or disk-cut grooves 11, whereby lands 12 between the grooves 11 are simultaneously formed. In FIG. 1B, on the contrary, the roll surface structure 10 is formed of separate plate disks 16, attached with welds 13 or formed to the roll frame or center shaft 15 in another method known as such, which form the lands 12, whereby the grooves 11 remain between them. In connection with FIG. 1B, there are alternative partial enlargements A', A" of detail A indicated in FIG. 1B.1 and 1B.2, in which according to the partial enlargement A', shown in FIG. 1B.1, a radius of curvature R can be used in the corners of the lands 12, such as plate disks 16, which R is approximately 0.1-7 mm, or according to the partial enlargement A", shown in FIG. 1B.2, the surface 17 of the land 12, such as a plate disk, can be formed large as to its radius of curvature R', with R' then being approximately 100-3000 mm.

According to the invention, regardless of the production method of the grooves, the edges 14, 17 of the land 12 supporting the clothing shown in the partial enlargements A', A" can be rounded or shaped so as to reduce wear of the clothing, such as a fabric. In this case the open surface area of the roll can be slightly increased, which improves the roll performance particularly in the closing nip area. When the open surface area increases, the groove depth can be slightly reduced, if required, without deteriorating the roll performance.

FIGS. 1C-1F illustrate the formation of the surface structure 10 of the roll according to the invention using the G strip technique, either without a support strip, FIG. 1C, or with the support strip, FIGS. 1D (grooved roll) and 1E (smooth roll). According to FIG. 1C, in the embodiment shown without a support strip, the G strip is applied slightly in a wedge form to the grooved roll shell 15, and the bottom part of the G strip is slightly narrowing. According to FIGS. 1D and 1E, a grooved support strip 18 is applied to the roll surface with the strip 12 forming the lands, and the dimensions of the actual groove strip 12 are e.g. 45×5 mm and the dimensions of the grooved support strip 18 are 8×12 mm.

To form an open surface structure 10 of the roll according to the invention of the various embodiments shown in FIGS. 1A-1G there are thus formed either grooves 11, with the lands 12 remaining between them, or land sections 12 are attached to the roll center shaft or frame 15, with the grooves 11 remaining between them. The depth S of each groove and thus the height of the land is approximately 10-155 mm, most appropriately 15-85 mm and the groove width L is 1-50 mm and the relation of the groove width L to the land width B is most appropriately 0.6-1.4.

According to a preferable embodiment shown in FIG. 1B the roll diameter is for example 1,500 mm. Separate plate disks have been welded to a frame construction having a diameter of 1,300 mm, which does not need to be an actual frame roll, but a support construction similar to it. The height of the plate disks is 100 mm and their thickness is 6 mm. A 7-mm wide open groove remains between the plate disks. A simulation model has given results according to which the roll generates a good vacuum on its surface both in the closing and opening nip as well as a vacuum of almost the same level −500 to −900 Pa in the rest of the fabric-covered area on the roll surface. With the plate arrangement/grooving according to this preferable embodiment the vacuum of the roll surface can be brought to a level of −500 to −900 Pa, based on the results achieved from the simulation, depending on the position of the wrap area and the running speed.

In FIG. 1F, according to a preferable embodiment of the invention, the open surface structure 10 of the roll has been formed by such land sections 12, which comprise a metal part 12A forming the frame construction 12A of the land, and by a filler section 12B, which is made for example of plastic or metal based material forming the other side wall of the groove 11. In the embodiment according to FIG. 1F the land sections 12 of the surface structure have been attached to the roll frame or center shaft with a support strip 18. This structure according to FIG. 1F has the advantage that the portions of metal and plastic can be optimized and the roll weight is also reduced and the renewal of the surface structure becomes easier.

FIG. 1G shows a preferable embodiment of the invention in which separate plate units are attached to one another or to the center shaft using friction of form closing attachments. In the embodiment of FIG. 1G plate disks 12 and 19 of different size have been attached to the roll frame for example by a shrink fit, whereby the alternately positioned plate disks form a surface grooving between them. It is also possible to produce plate disks comprising the structure of the disks 12 and 19, which are then attached to each other using for example a form closing attachment. The use of plate disks of a different size also enables providing at least one roll part with a grooving of different depth, allowing to optimize the groove depth at the roll edges, for example, based on the generation of the maximum vacuum output.

Figure 2A:
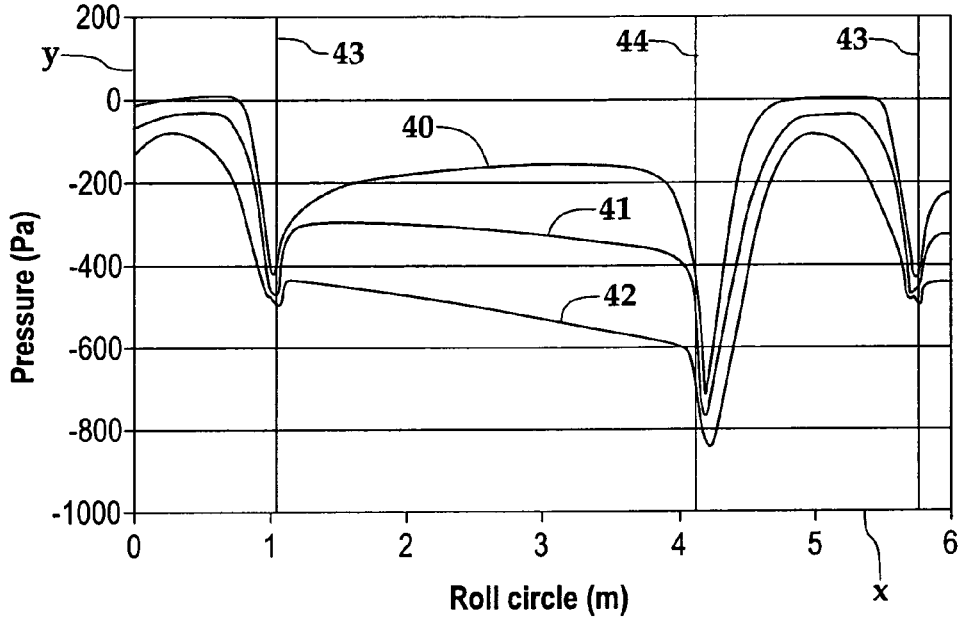
FIGS. 2A and 2B illustrate examples of the effect of closing the open space between the plates and the center area in the roll according to the invention.

FIG. 2A shows the effect of closing the open space between the plates and the center shaft of the roll used in the embodiment according to FIG. 1A. In the figure, X-axis represents the roll circle and Y-axis the pressure in the roll grooves. The top curve 40 in the figure illustrates an arrangement in which there is an open space between the plates and the center shaft, i.e. an arrangement according to the prior art technique, the center curve 41 and the bottom curve 42 represent situations in which the space interval between the plates and the center roll is closed, i.e. embodiments of the invention. Number 43 indicates a closing nip and number 44 an opening nip. The figure also shows pressure peaks present in the rotational pressure at the opening nip and at the closing nip. As shown in the simulation figure, the roll according to the invention can provide the above-mentioned rotational pressure on the roll surface. In the simulation the roll diameter was kept at 1,500 mm and the groove depth was 250 in the cases ofthe curves 40 and 41, and 125 mm in the graph of curve 42. The curves show that a groove closed at the center space generates greater vacuum than an open solution, and for the groove depths, 250 mm produces less vacuum than 125 mm.

Figure 2B:
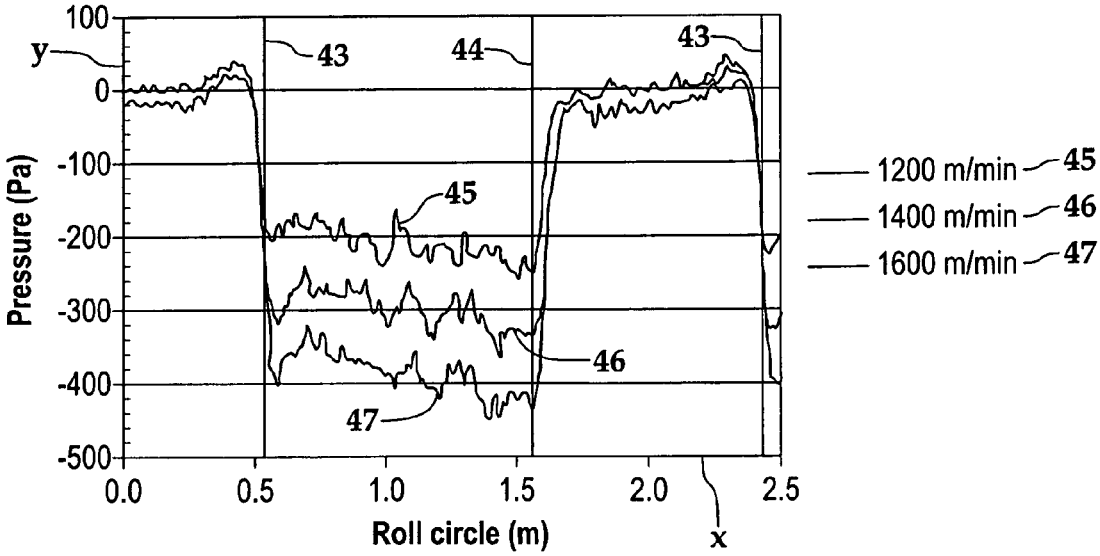

FIG. 2B illustrates measurement results of the effect of the running speed on the vacuum level of the roll circle showing that a speed increase increases the vacuum. This is preferable, because with a rising speed it is preferable that the forces keeping the web attached to the fabric surface at the turning roll also increase. Curve 45 represents the influence of the running speed 1,200 m/min on the vacuum level of the roll circle, curve 46 represents the influence of the running speed 1,400 m/min on the vacuum level of the roll circle, and curve 47 represents the influence of the running speed 1,600 m/min on the vacuum level of the roll circle. A closing nip is marked with number 43 and an opening nip with number 44.

Figure 3:
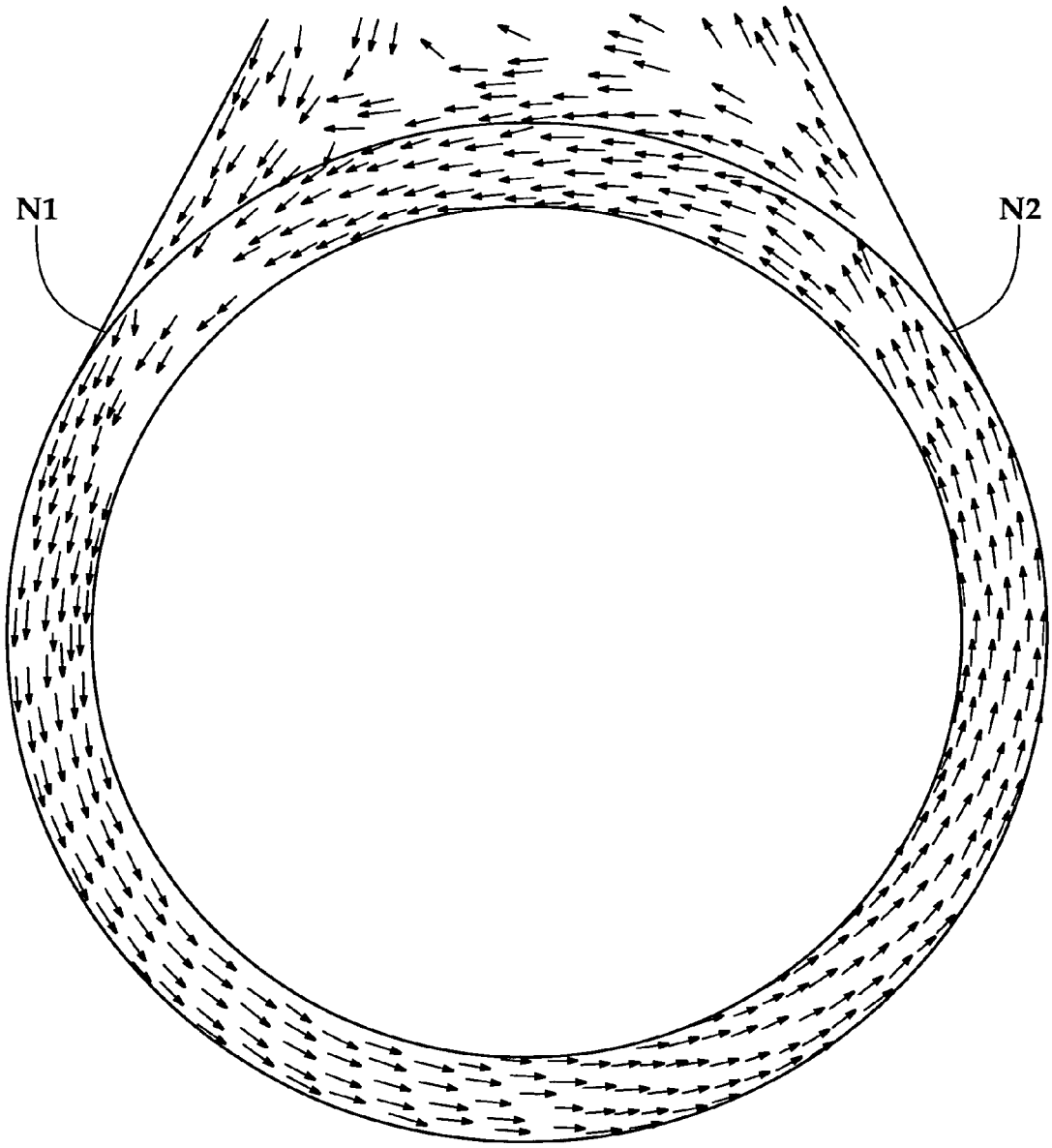
FIG. 3 is a schematic view of the flow behavior taking place in connection with the roll according to the invention.

FIG. 3 depicts the flow behavior in the roll according to the invention for example in an embodiment according to FIG. 1A, in which arrows are used to indicate the airflow. According to the invention, in the area of the closing nip N1 the boundary layer airflow and a possible blasting flow hit against the roll plates. The impact produces airflows in the radial direction, and the flow between the plates accelerates being essentially an airflow in the tangential direction of the periphery. The flow continues until to the opening nip N2 essentially in the direction of the tangential flow of the periphery.

Figure 4:
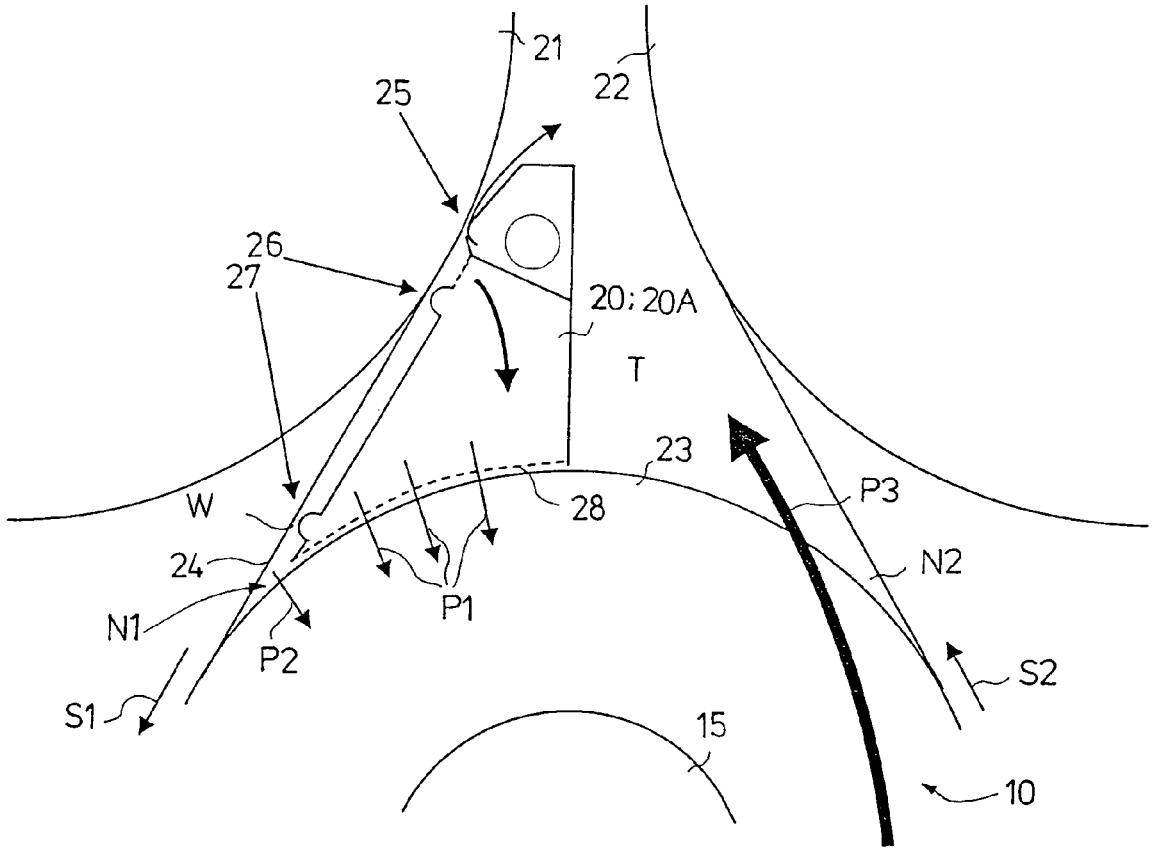
FIGS. 4-6 show a schematic view of embodiments according to the preferable further characteristics of the invention, in which there is a blow box arranged in connection with the roll.
Figure 5:
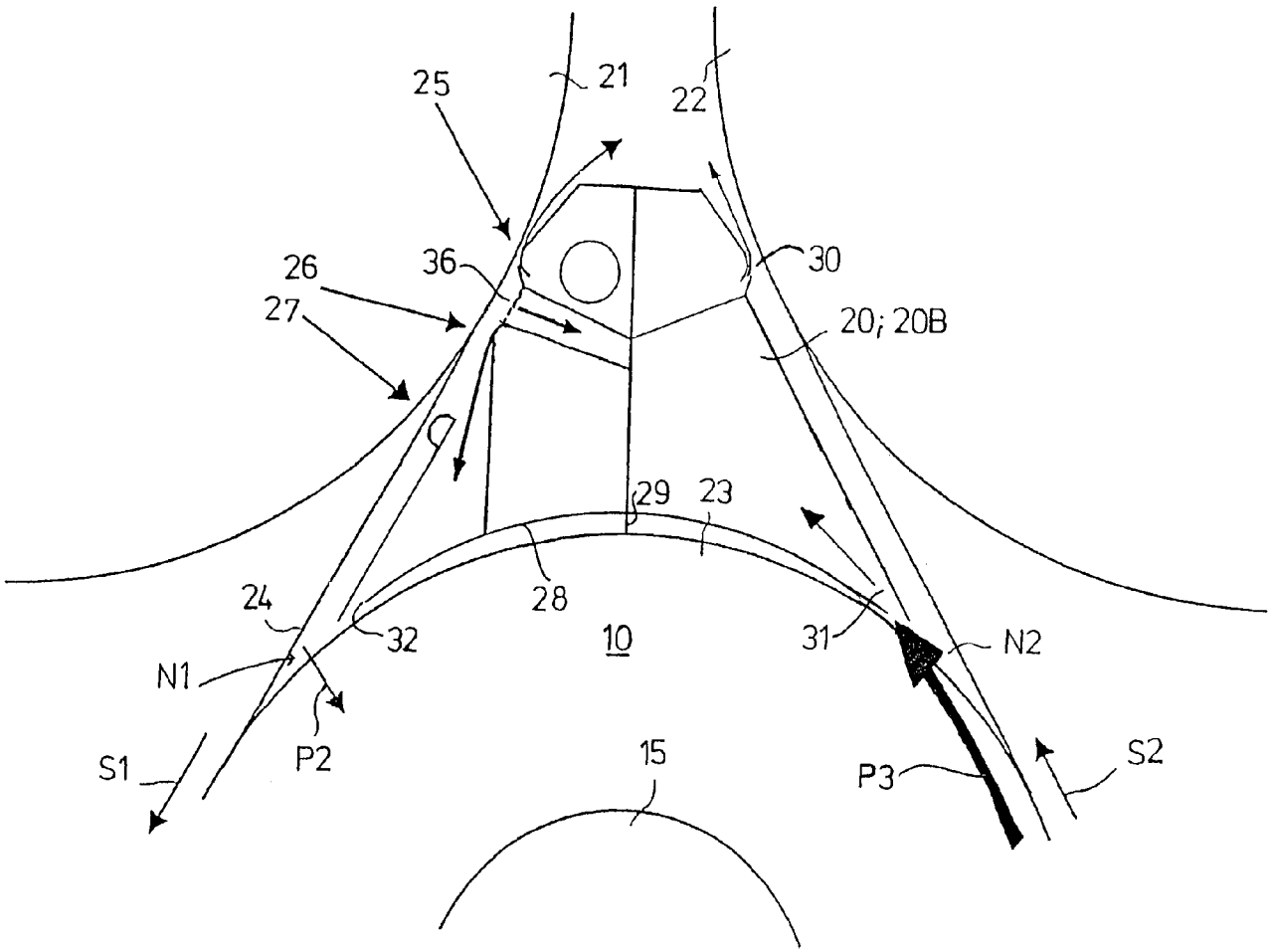
Figure 6:
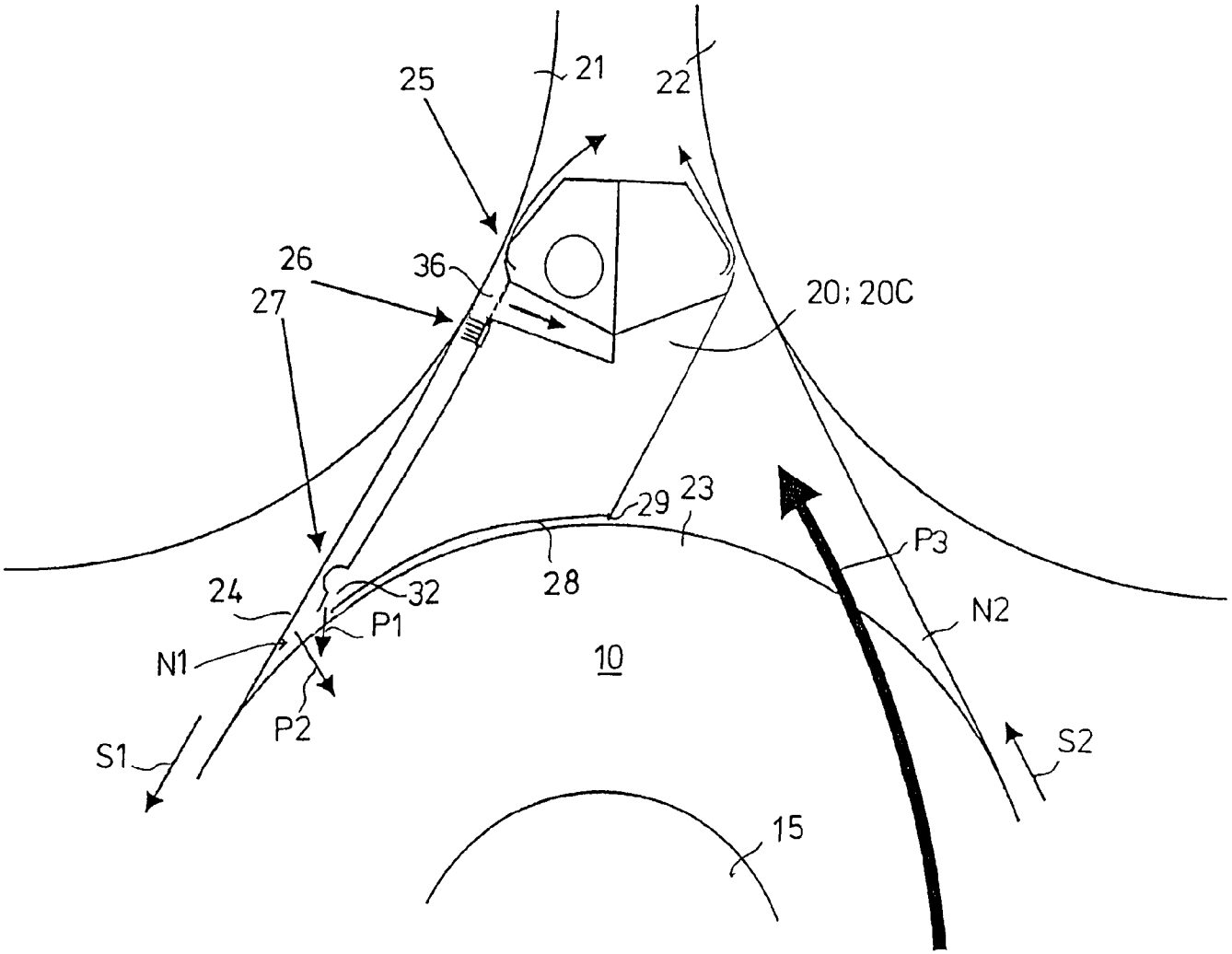

In the embodiments according to FIGS. 4-6, for preventing overpressurization of the pocket space T, a blow box 20; 20A, 20B, 20C is used. The blow box 20 is located in the pocket space T formed by the dryer cylinders 21, 22 and the roll 23, and it is provided with a flexible blow nozzle 25, which is used to partly control the stream of the boundary layer flow conveyed with the fabric 24 to the closing nip N1. Further, the blow box is provided with projections 26, 27 having a distance adjustment possibility, if required. This can be used to prevent the fabric from conveying air with it and to seal the influence area of the vacuum zone restricted and thus more efficient. In boxes 20 producing a high vacuum it may also be preferable to use labyrinth sealing as shown in FIG. 6 for the sealing 26. In the embodiment according to FIG. 4 the blow box 20 has a bottom surface 28 open towards the roll, from which the airflows P1 are conveyed to inside the roll 23 according to the invention, intensifying in this way the in-pumping effect P2 of the roll 23. In the embodiments shown in FIGS. 5 and 6, the bottom plate is without perforations, and, if required, inward pumping can be controlled with the nozzle 32 or even by using a blow nozzle in position 26. This allows leading the blast air also through the interior of the box with adjustment of the air volume led to the roll 23 by removing part of the blast air. This prevents the canal between the box 20 and the fabric 24 from becoming overpressurized, which would hinder the runnability. Arrow P3 indicates the airflow led outwardly from the roll 23 according to the invention in the area of the opening nip N2, which further intensifies the runnability. Arrows S1, S2 indicate the travel direction of the fabric 24. In the embodiments shown in FIGS. 4-6, the sealing 29 separating the nip influence areas N1 and N2 is also shown in the boxes 20.

FIG. 4 shows a so called half-pocket box 20A, which fills the pocket space T on the side of the closing nip N1 and leaving open the side of the opening nip N2 of the pocket T, allowing the airflows of the trailing/up-going side to be freely removed form the pocket space without deteriorating the roll 23 performance.

FIG. 5 shows a so called box that fills the entire space, which fills the pocket space T and in which on the side of the opening nip N2 there is created a blow that intensifies the airflow P3 with the nozzle 30, allowing thus to raise the vacuum production capability of the roll, while the aspiration 31 can still be used directly from the opening nip N2.

FIG. 6 shows a blow box 20C, which in a sense represents an intermediate form between the blow boxes 20A, 20B illustrated in FIGS. 4 and 5, and it has further a blow nozzle 32, which can be used to adjust/intensify the vacuum production capability of the roll 23.

Via the embodiments of FIGS. 4-8 it should be noted that the roll 23 functions as an active pump, in which case the blow boxes 20 and their use must be made in such a way that the flow-through air necessary for the roll operation exists. A preferable application principle is particularly the solution of FIG. 5, which can be used to efficiently control the roll 23 operation.

Figure 8:
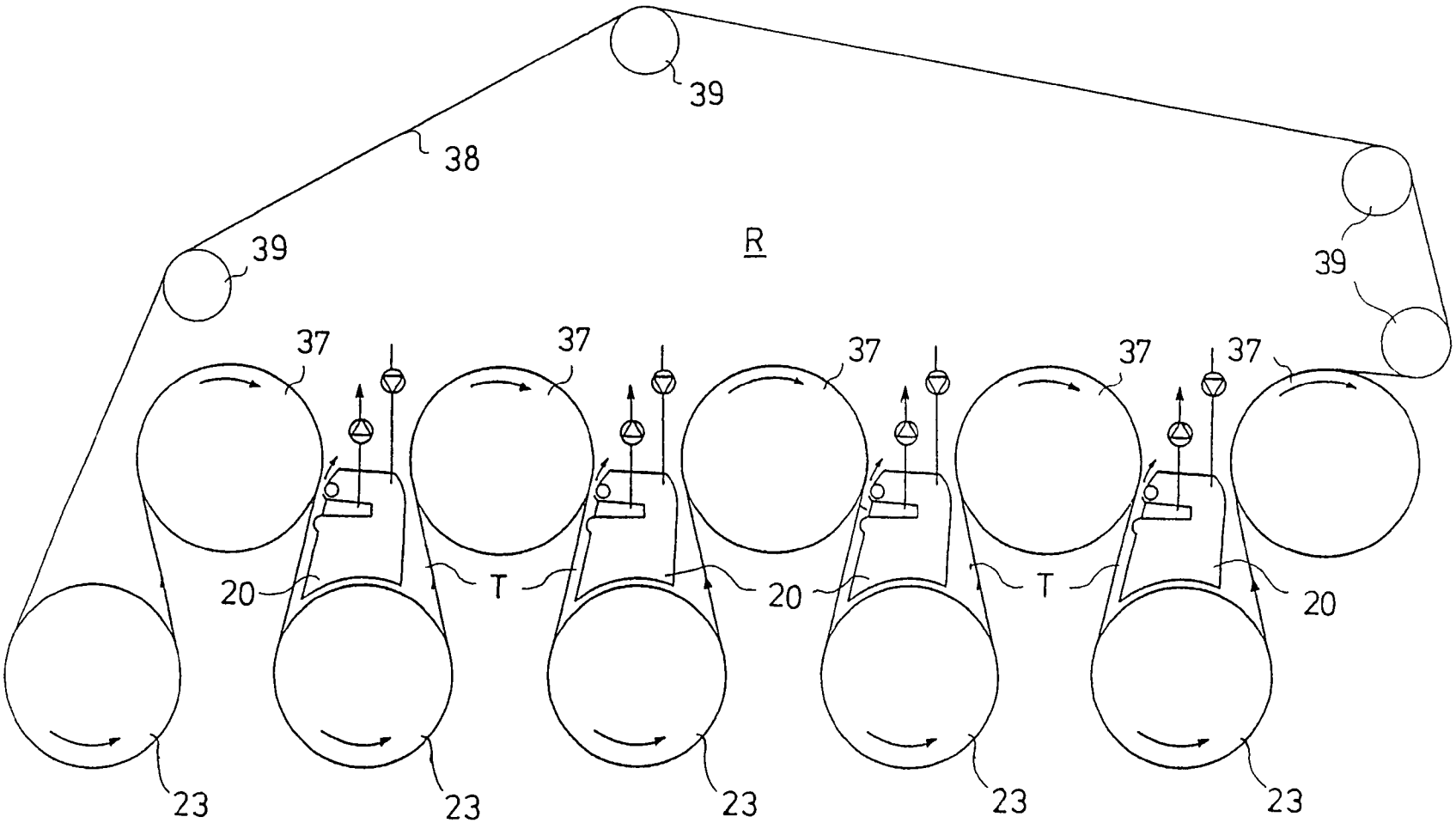

The solutions illustrated in FIGS. 5, 6 and 8 are preferable for the vacuum control of the pocket space T and for the intensification and control of the vacuum generated by the roll 23. Particularly at the beginning stage of drying, higher vacuum is required especially for the runnability component of the pocket space (blow box), and the control of vacuum generated by the roll is also more useful in this case. At the final stage of drying it may be preferable to use a box according to FIG. 8 or even of FIG. 4, the paper being then drier and easier to control.

Figure 7:
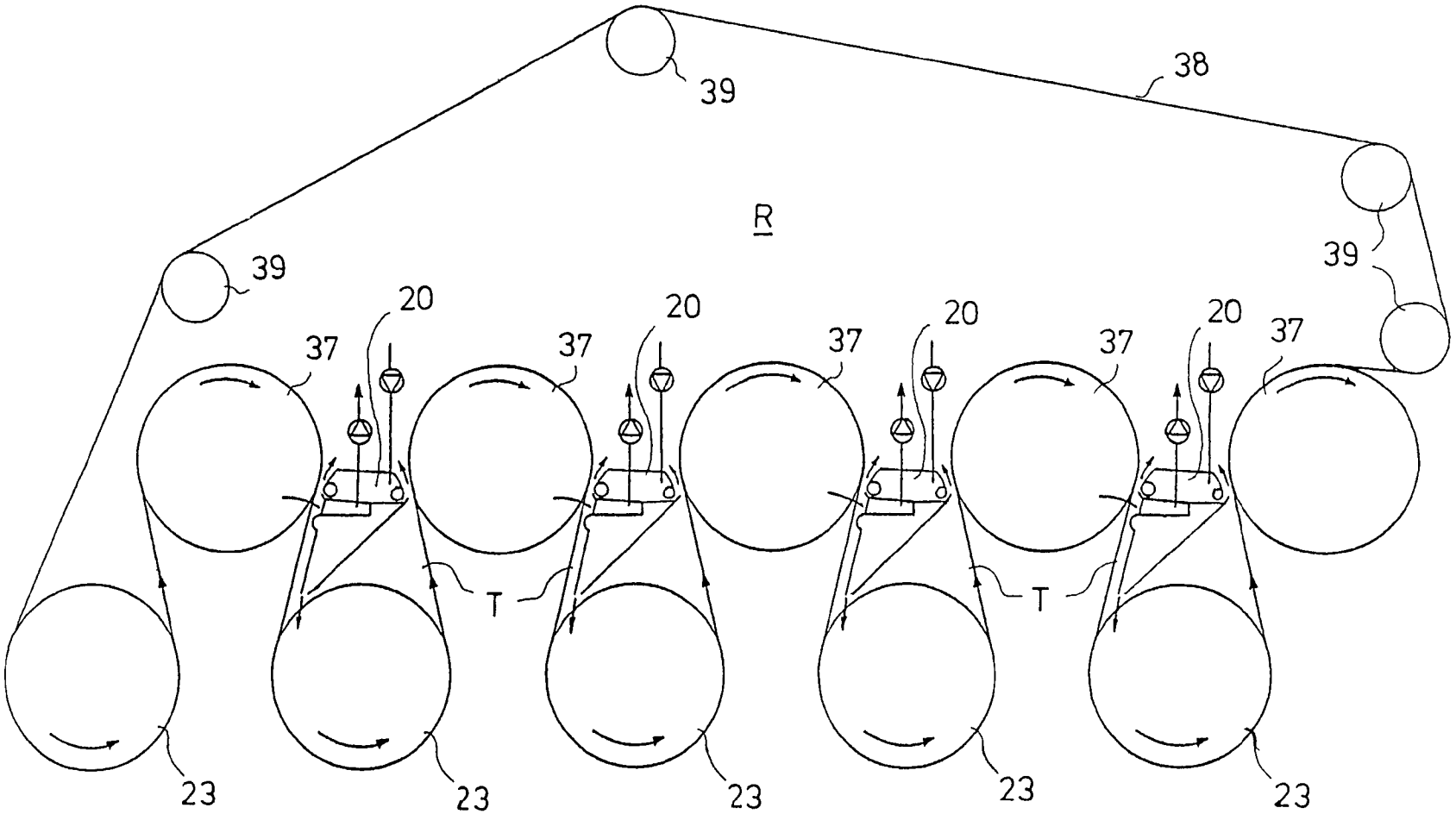
FIGS. 7-8 show a schematic view of preferable embodiments of the invention in connection with dryer groups adopting the single fabric run arrangement.

FIGS. 7 and 8 show schematic views of dryer groups R adapting single fabric run arrangements, with rolls 23 according to the invention located as turning rolls and pocket spaces T, equipped with a blow box 20, being used in connection therewith. The top row dryer cylinders are indicated with reference number 37 and the dryer fabric and its lead and guide rolls are referred to with numbers 38 and 39 respectively. FIG. 7 shows an embodiment, in which in the pocket spaces T of a dryer group R adapting a single fabric run arrangement, there is located a blow box 20C, which corresponds primarily to the embodiment illustrated in FIG. 6, allowing to optimize the vacuum production of rolls 23 considering the position of the group in the dryer section.

FIG. 8 shows an embodiment, in which the blow box 20 located in the pocket spaces T corresponds primarily to the embodiment illustrated in FIG. 4, in which a plate without perforations 28 is applied and the suction at the opening nip of the cylinder is intensified with a separate suction connection 36. Dryer groups R of the type illustrated in FIGS. 7 and 8 are particularly suitable for use as dryer groups at the beginning of the dryer section.

The invention is described above by making reference only to some of its preferable embodiments to the details of which the invention is not, however, intended to be strictly limited in any way.

We claim:

1. A dryer group in a paper or board machine comprising:

a first contact dryer cylinder, a second dryer cylinder and a turning cylinder positioned therebetween;

a single dryer fabric and a paper or board web arranged to travel over the first contact dryer cylinder with the paper or board web between the first contact dryer cylinder and the dryer fabric, and the paper or board web arranged to wrap around the turning cylinder supported by the dryer fabric to define a wrap area, and the dryer fabric and the paper or board web arranged to travel over the second dryer cylinder with the paper or board web between the second dryer cylinder and the fabric so that the paper or board web remains between the second dryer cylinder surface and the dryer fabric;

wherein the dryer group turning cylinder is a roll comprising a groove-like surface structure and a center shaft or a roll frame, wherein there is contact between the surface structure and the center shaft or roll frame so that a closed construction is formed except for a portion of the roll used for threading a tail;

wherein the turning cylinder roll is arranged with the dryer fabric to produce a vacuum that keeps the paper or board web attached to the dryer fabric at an outer surface within the wrap area of the turning cylinder;

wherein the groove-like surface structure has portions forming grooves 18-155 mm deep and 6-10 mm wide, and wherein lands of a defined width are formed between the grooves, and wherein the ratio of groove width to land width is 0.6 to 2.0, and the ratio of groove width to depth is 2.25 or greater.

2. The dryer group of claim 1, wherein the lands have rounded edges with a radius of 1-3 mm.

3. The dryer group of claim 1, wherein the lands have an outermost surface having a radius of curvature of 100-500 mm.

4. The dryer group of claim 1, wherein the ratio of groove width to depth is 3.5 or greater.

5. The dryer group of claim 1, wherein the ratio of groove width to depth is between about 2.25 and 16.

6. A dryer group in a paper or board machine comprising:

a first contact dryer cylinder, a second dryer cylinder and a turning cylinder positioned therebetween;

a single dryer fabric and a paper or board web arranged to travel over the first contact dryer cylinder with the paper or board web between the first contact dryer cylinder and the dryer fabric, and the paper or board web arranged to wrap around the turning cylinder supported by the dryer fabric to define a wrap area, and the dryer fabric and the paper or board web arranged to travel over the second dryer cylinder with the paper or board web between the second dryer cylinder and the fabric so that the paper or board web remains between the second dryer cylinder surface and the dryer fabric;

wherein the dryer group turning cylinder is a roll comprising a groove-like surface structure and a center shaft or a roll frame, wherein there is contact between the surface structure and the center shaft or roll frame so that a closed construction is formed except for a portion of the roll used for threading a tail;

wherein the turning cylinder roll is arranged with the dryer fabric to produce a vacuum that keeps the paper or board web attached to the dryer fabric at an outer surface within the wrap area of the turning cylinder;

wherein the groove-like surface structure has portions forming grooves 18-155 mm deep and 6-10 mm wide, and wherein lands of a defined width are formed between the grooves, and wherein the ratio of groove width to land width is 0.6 to 2.0, and the ratio of groove width to depth is 2.25 or greater; and wherein the depth of the of the grooves is selected to produce a vacuum on the surface structure of the turning cylinder which is wrapped by the paper or board web which is at least about 200 Pa when the dryer group is operated at a machine speed greater than 1200 meters per minute.

7. A dryer group in a paper or board machine comprising:

a first contact dryer cylinder, a second dryer cylinder and a turning cylinder positioned therebetween;

a single dryer fabric and a paper or board web arranged to travel over the first contact dryer cylinder with the paper or board web between the first contact dryer cylinder and the dryer fabric, and the paper or board web arranged to wrap around the turning cylinder supported by the dryer fabric to define a wrap area, and the dryer fabric and the paper or board web arranged to travel over the second dryer cylinder with the paper or board web between the second dryer cylinder and the fabric so that the paper or board web remains between the second dryer cylinder surface and the dryer fabric;

wherein the dryer group turning cylinder is a roll comprising a groove-like surface structure and a center shaft or a roll frame, wherein there is contact between the surface structure and the center shaft or roll frame so that a closed construction is formed except for a portion of the roll used for threading a tail;

wherein the turning cylinder roll is arranged with the dryer fabric to produce a vacuum that keeps the paper or board web attached to the dryer fabric at an outer surface within the wrap area of the turning cylinder;

wherein a pocket space is defined between the first contact dryer cylinder, the second dryer cylinder, the turning cylinder roll, and the fabric, and wherein a runnability component system is positioned within the pocket;

wherein the runnability component system has a lower portion arranged so that air is drawn from the runnability component system in to the grooves of the turning cylinder roll; and wherein the pocket space is arranged to allow air from the grooves of the turning cylinder roll to pass out of the pocket space.

8. The dryer group of claim 7, wherein the runnability component system in the pocket space of the dryer group is functionally divided into at least two parts.

9. The dryer group of claim 7, wherein the runnability component system is arranged to produce a different vacuum in different functional parts utilizing the ejection or suction principle in a blow box.

10. A method of controlling runnability in a dryer group of a paper or board machine having a first contact dryer cylinder, a second dryer cylinder and a grooved turning cylinder positioned therebetween, the method comprising the steps of:

passing a paper or board web over the first contact dryer cylinder with the paper or board web between the first contact dryer cylinder and a dryer fabric;

wrapping the paper or board web around the turning cylinder supported by the dryer fabric to define a wrap area;

wrapping the dryer fabric and the paper or board web to travel over the second dryer cylinder with the paper or board web between the second dryer cylinder and the fabric so that the paper or board web remains between the second dryer cylinder surface and the dryer fabric;

wherein the paper or board web and the fabric travel over a grooved turning cylinder having a groove-like surface structure and a center shaft or a roll frame, wherein there is contact between the surface structure and the center shaft or roll frame so that a closed construction is formed except for a portion of the roll used for threading a tail, and wherein the paper or board web and the fabric travel at a running speed of at least about 1200 meters per minute, and wherein the grooves are selected with a configuration to produce a vacuum of at least about 200 Pa where the paper or board web and the fabric travel over the grooved turning cylinder at said least about 1200 meters per minute;

defining a pocket space between the first contact dryer cylinder, the second dryer cylinder, the turning cylinder roll, and the fabric, and positioning a runnability component system within the pocket;

drawing air from the runnability component system into the grooves of the turning cylinder roll; and exhausting air from the grooves of the turning cylinder roll outwardly into the pocket space.

11. The method of claim 10 wherein the paper or board web and the fabric travel over the grooved turning cylinder at a running speed of at least about 1400 meters per minute, and wherein the grooves are selected with a configuration to produce a vacuum of at least about 300 Pa.

12. The method of claim 11 wherein the paper or board web and the fabric travel over the grooved turning cylinder at a running speed of at least about 1600 meters per minute, and wherein the grooves are selected with a configuration to produce a vacuum of at least about 400-900 Pa.

* * * * *